United States Patent [19]

Schwartz et al.

[11] 4,397,688

[45] Aug. 9, 1983

[54] CONTINUOUS PROCESS OF SMELTING METALLIC LEAD DIRECTLY FROM LEAD- AND SULFUR-CONTAINING MATERIALS

[75] Inventors: Werner Schwartz, Buchholz; Peter Fischer, Bad Vilbel, both of Fed. Rep. of Germany

[73] Assignee: Metallgesellschaft Aktiengesellschaft, Frankfurt am Main, Fed. Rep. of Germany

[21] Appl. No.: 271,078

[22] Filed: Jun. 8, 1981

[30] Foreign Application Priority Data

Aug. 6, 1980 [DE] Fed. Rep. of Germany ..... 3029741

[51] Int. Cl.[3] ..... C22B 15/00

[52] U.S. Cl. ..... 75/77; 75/92

[58] Field of Search ..... 75/77, 92

[56] References Cited

U.S. PATENT DOCUMENTS 4,266,971 5/1981 Schwartz et al. ..... 75/77

*Primary Examiner*—M. J. Andrews

*Attorney, Agent, or Firm*—Sprung, Horn, Kramer & Woods

[57] ABSTRACT

A slag phase and lead phase are conducted in a countercurrent to each other in an elongated horizontal reactor, in which a gas atmosphere is conducted in a countercurrent to the slag phase. To maintain the molten bath at a constant temperature and to permit an operation at the lowest possible temperatures whereby an undercooling of the melt is prevented, the temperature of the molten bath in the reducing zone is maintained constant by a controlled supply of additional heat, the temperature of the molten bath in the oxidizing zone is maintained constant by a control of the ratio of oxidizable sulfur to oxygen in such a manner that in case of a temperature rise the ratio of sulfur to oxygen is increased in order to decrease the lead oxide content of the slag and in case of a temperature drop of the ratio of sulfur to oxygen is decreased in order to increase the lead oxide content of the slag and the increase and decrease of the ratio of sulfur to oxygen are controlled allowing for the fact that the heat content of the gases entering the oxidizing zone from the reducing zone is changed with the lead oxide content of the slag.

3 Claims, 1 Drawing Figure

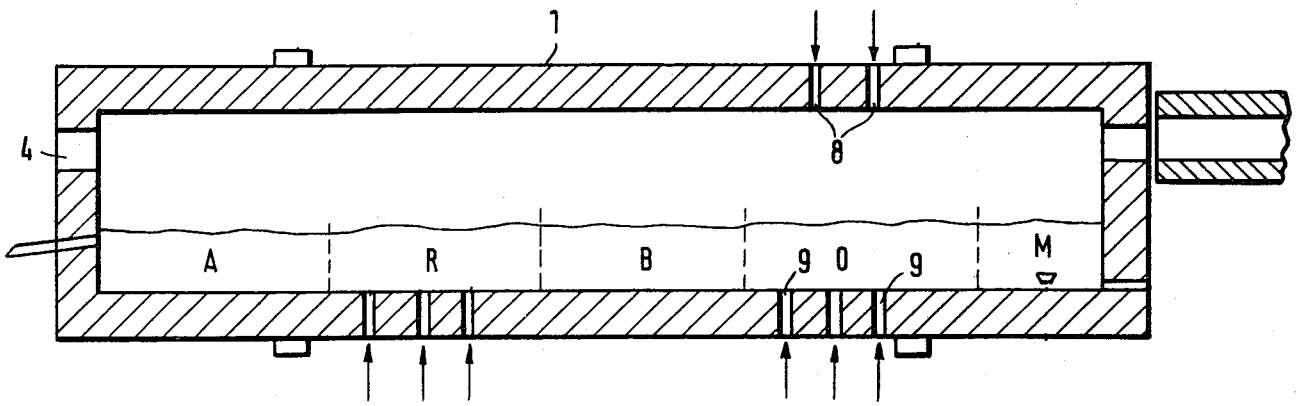
A
R
B
9
8
9
M
D
7
4

CONTINUOUS PROCESS OF SMELTING METALLIC LEAD DIRECTLY FROM LEAD- AND SULFUR-CONTAINING MATERIALS

BACKGROUND OF THE INVENTION

1. Field of the Invention

This invention relates to a continuous process of smelting metallic lead directly from lead- and sulfur-containing materials in an elongated horizontal reactor, wherein a molten bath consisting of a slag phase and a lead phase is maintained in the reactor, the slag phase and the lead phase are countercurrently conducted through the reactor, the gas atmosphere is conducted countercurrently to the slag phase through the reactor, oxygen is blown into the molten bath from below at controlled rates in the oxidizing zone, which is disposed on the side where the lead is tapped, lead- and sulfur-containing material is charged at controlled rates onto the molten bath, reducing agent is introduced into the molten bath in the reducing zone, which is disposed on the side where the slag is tapped, additional heat is supplied to the gas space in the reducing zone, such an oxidation potential is maintained in the oxidizing zone that the charge is smelted in a thermally self-sufficient process to form metallic lead and a slag which contains lead oxide, and the rate of the reducing agent and the temperature in the reducing zone are so controlled that a low-lead slag is formed.

2. Discussion of Prior Art

German Offenlegungsschrift No. 28 07 964 discloses a continuous process of converting lead sulfide concentrates into a liquid lead phase and a slag phase under a gas atmosphere having $SO_2$-containing zones in an elongated horizontal reactor. In that known process, lead sulfide concentrates and fluxes are charged onto the molten bath. The lead phase and a low-lead slag phase are discharged at mutually opposite ends of the reactor. The phases flow countercurrently to each other in substantially continuous layer-forming streams to the outlet ends. At least part of the oxygen is blown into the molten bath from below through a plurality of mutually independently controlled nozzles, which are distributed over the length of the oxidizing zone of the reactor. The solid charge is charged into the reactor in several stages through a plurality of mutually independently controlled feeders, which are distributed over a substantial length of the reactor.

The locations and rates at which oxygen and solids are fed are so selected that the gradient of the oxygen activity in the molten bath has at the end where lead is tapped a maximum for the production of lead and from said maximum decreases progressively to a minimum for the production of low-lead slag phase, which minimum is obtained at the end where said slag phase is tapped.

Gaseous and/or liquid protective fluids are blown into the molten bath at controlled rates together with the oxygen and serve to protect the nozzles and the surrounding lining and to assist the control of the process temperature. The rates at which gases are blown into the molten bath are so controlled that the resulting turbulence is sufficient for a good mass transfer but will not substantially disturb the flow of the phases in layers and the gradient of the oxygen activity. The gas atmosphere in the reactor is conducted countercurrently to the direction of flow of the slag phase. The exhaust gas is withdrawn from the reactor at the end where the lead phase is tapped. To produce a low-lead slag, reducing agents are introduced into the reducing zone and additional heat is supplied into the gas space in said zone so that the heat to be absorbed in reaction is supplied and the slag is heated in the reducing zone. Stilling zones in which no gases are blown into the molten bath may be provided between the oxidizing and reducing zones and also before the oxidizing zone and behind the reducing zone.

The temperature of the molten bath in the oxidizing and reducing zones should be kept as low as possible so that an attack of overheated slag on the brickwork will be avoided as well as the need for the otherwise required cooling of the brickwork at higher temperatures, also a strong evaporation of metals or metal compounds and an unnecessary heating of the lead phase. But low processing temperatures involve a risk of an undercooling of the molten bath during fluctuations in operation.

German Pat. No. 23 20 548 discloses a direct lead-melting process wherein a mixture of fine-grained lead sulfide and oxygen impinges on a molten bath from above with ignition and formation of a flame. A considerable part of the oxidation is already effected in the furnace atmosphere. The flame temperature is above 1300° C. and the temperature of the molten bath between 1100° and 1300° C. in the oxidizing zone. The slag phase and the furnace atmospheres are countercurrently conducted through the furnace. A slag containing at least 35% lead as lead oxide is tapped from the furnace and is reduced in a separate reducing furnace. 98% to 120% of the quantity of oxygen which would be stoichiometrically required for a complete conversion of the lead sulfide to metallic lead are needed to produce the lead phase. To control the furnace temperature, about 120% oxygen can be added during short periods to effect an increased transfer of lead oxide to the slag. But that temperature control cannot be adopted in the above-described process carried out in a reactor which includes oxidizing and reducing zones and from which a low-lead slag is tapped. Besides, that temperature control will not avoid the disadvantages involved in high temperatures of the molten bath and in an overheated slag.

SUMMARY OF THE INVENTION

It is an object of the invention to provide a direct lead-smelting process which is of the kind described first hereinbefore and in which the temperatures of the molten bath are minimized and maintained constant throughout the reactor and an undercooling of the molten bath is prevented even during a fluctuating operation.

This object is accomplished according to the invention in that the temperature of the molten bath in the reducing zone is maintained constant by a controlled supply of additional heat, the temperature of the molten bath in the oxidizing zone is maintained constant by a control of the ratio of oxidizable sulfur to oxygen in such a manner that in case of a temperature rise the ratio of sulfur to oxygen is increased in order to decrease the lead oxide content of the slag and in case of a temperature drop the ratio of sulfur to oxygen is decreased in order to increase the lead oxide content of the slag and the increase and decrease of the ratio of sulfur to oxygen are controlled, allowing for the fact that the heat content of the gases entering the oxidizing zone from the reducing zone is changed with the lead oxide content of the slag.

The partial oxidation of the charged lead sulfide to metallic primary lead and a high-PbO primary slag in the oxidizing zone can be approximately described by the following formula:

$$PbS+3-n/2\ O_2=n\ Pb+(1-n)PbO+SO_2$$

If n=0, all lead will enter the slag as PbO. If n=1, all lead will become available as metallic lead. If n=0.5, one-half of the lead will enter the slag as PbO and the other one-half will become available as metallic lead. For simplification, it will be assumed that the oxidizable sulfur consists only of the sulfide sulfur combined with lead and that the oxygen consists only of the gaseous oxygen which is supplied. When the temperature in the oxidizing zone rises above the desired value, the ratio of charged oxidizable sulfur to oxygen in the oxidizing zone will be increased so that more metallic lead will be produced and less PbO will enter the slag and correspondingly less heat will be generated. But the ratio of sulfur to oxygen is not increased in correspondence to the temperature rise because the PbO content of the slag entering the reducing zone contains less PbO so that less work of reduction is to be performed therein. As the temperature in the reducing zone is maintained constant, less additional heat is supplied there so that with a certain time delay the gas leaving the reducing zone supplies less heat to the oxidizing zone. The decrease of the heat quantity is taken into account in the increase of the ratio of sulfur to oxygen, which ratio is only correspondingly increased.

The reverse process is carried out in response to a temperature drop in the oxidizing zone. Unless the temperature in the reducing zone is maintained constant and the change of the heat content of the gases flowing from the reducing zone to the oxidizing zone is taken into account, a change of the ratio of sulfur to oxygen will result in continual temperature fluctuations. A higher ratio of sulfur to oxygen will increase the evaporation of PbS so that a certain additional cooling is effected. A lower ratio will have the opposite effects. The extent to which the ratio of sulfur to oxygen is changed in response to a temperature change in the oxidizing zone depends on the reactor and the operating conditions. The required extent can be calculated or empirically determined. The control may be effected in steps.

According to a preferred further feature, a temperature of the molten bath of 900° to 1000° C. is maintained in the oxidizing zone and a temperature of 1100° to 1200° C. in the reducing zone. At these temperatures, a satisfactory reaction rate is obtained in the oxidizing zone and a low-lead slag is obtained in the reducing zone in conjunction with a low oxygen consumption and heat consumption, and an undercooling of the molten bath is reliably avoided by the automatic temperature control. Additionally, the losses by evaporation are still relatively low.

According to a further preferred feature a slag composition comprising 45 to 50% $ZnO+FeO+Al_2O_3$, 15 to 20% $CaO+MgO+BaO$ and 30 to 35% $SiO_2$, based on lead-free slag, and 30 to 70% PbO is maintained in the oxidizing zone. With slags of that type, low temperatures can be particularly well maintained with good results of the processing.

BRIEF DESCRIPTION OF DRAWING

The annexed drawing shows in horizontal cross-section an apparatus for carrying out the process.

DESCRIPTION OF SPECIFIC EMBODIMENTS

Referring to the drawing, the temperature of the molten bath in reducing zone R and working zone (A) is maintained constant by control of the additional heat supplied by a burner through opening 4 into the gas atmosphere and from there by heat exchange into the bath. In case of a temperature rise of the molten bath in oxidizing zone 0, the ratio of sulphur to oxygen in this zone is increased in order to decrease the lead oxide content of the slag developed in the oxidizing zone and thereby decreasing the temperature of the bath in oxidizint zone 0.

The increase of the ratio is performed by respective changing of the amount of material charged through charging openings 8 and oxygen injected through nozzles 9. The ratio of sulphur to oxygen is not increased in direct lineal proportion to that decrease of the content of lead oxide of the slag produced in the oxidizing zone which would equal the temperature rise in the oxidizing zone 0. When this slag has flown into the reducing zone R and as the temperature is maintained constant in reducing zone R, less additional heat is supplied by the burner through opening 4 so that with a certain time delay the gases leaving the reducing zone R supply less heat to the oxidizing zone 0. This decrease of heat quantity is taken into account in the increase of the ratio of sulphur to oxygen and the ratio is only correspondingly increased. The reverse process is carried out in response to a temperature drop in the oxidizing zone.

The invention will be explained more fully with reference to Examples.

EXAMPLES

A galena concentrate containing 73.6% Pb and 15.8% S was mixed with 20% fine lead sulfate dust (62.3% Pb, 6.5% S) and with slag-forming fluxes. The mixture was pelletized. The resulting pellets had the following composition:

67.9% Pb
12.3% S
0.9% Zn
4.7% FeO
1.3% CaO
0.3% MgO
3.5% $SiO_2$
6.8% moisture

These high-PbS pellets were continuously charged into a refractory-lined reactor consisting of a horizontal cylinder having an inside length of 4.50 m and an inside diameter of 1.20 m. The reactor was provided at its front end with an auxiliary burner and an overflow tap for the slag and at its rear end with an exhaust gas outlet. The charging opening was provided at the shell of the reactor close to the end wall where the exhaust gas was withdrawn.

In this way, the gas and slag phases were forced to flow countercurrently. The reactor was too short for a simultaneous performance of the oxidation of the lead sulfide and the reduction of the high-lead primary slag in juxtaposed zones.

Before the beginning of the experiments, the reactor was supplied with 2.5 metric tons metallic lead and 1 metric ton of high-lead oxide slag (65% Pb). These materials were melted and heated to 950° C. with the aid of the burner. Commercial-grade oxygen was then blown into the lead bath at the bottom of the reactor at such a rate that the pellets charged onto the bath were reacted to form metallic lead, high-lead oxide slag and $SO_2$ gas laden with fine dust.

1. In a first experiment, a oxygen was supplied at a constant rate of 150 $m^3/h$ (NTP) (without infiltrated air) and the pellet rate was varied.

It was found that when the burner was shut down the temperature of the molten bath could be maintained constant at 950° C. when the pellets were supplied exactly at a rate of 2.1 metric tons per hour. Under these conditions the slag leaving the reactor contained 63.4% Pb, on an average. 44% of the lead contained in the pellets entered the metal phase, 40% the slag phase and 16% the gas phase. When the latter had been cooled, its lead content was reacted with $SO_2$ and $O_2$ to form lead sulfate, which was separated as fine dust.

2. A second experiment was initially conducted like the first and served to investigate the influence of a change of the pellet supply rate on the temperature of the molten bath. A decrease of the pellet supply rate to 2.0 metric tons per hour resulted in a temperature rise to 965° C. in the oxidizing zone accompanied by an increase of the Pb content of the slag to 65.1%. An increase of the pellet supply rate to 2.2 metric tons per hour resulted in a temperature drop of the molten bath to 940° C. in the oxidizing zone and a decrease of the Pb content of the slag to 59.8%.

3. In a third experiment, which was also initially conducted like the first, an oxygen supply rate of 150 $m^3/h$ (NTP) and a pellet supply rate of 2.1 metric tons per hour were maintained and the temperature of the molten bath in the oxidizing zone was raised to 1000° C. by means of the burner.

In this way, a supply of heat by the gas phase flowing in a countercurrent to the slag phase from an imaginary reducing zone which is at a higher temperature was simulated.

Under these conditions the slag contained 63.7% Pb.

Without a change of the burner output and the oxygen supply rate, the pellet supply rate was then cautiously increased. It was found that the bath reached a temperature of 950° C. in the oxidizing zone when pellets were supplied at a rate of 2.7 metric tons per hour. Then the slag leaving the reactor contained only 48.4% Pb and 51% of the lead contained in the pellets entered the metallic phase, 29% entered the slag phase and 20% the gas phase.

The advantages afforded by the invention reside in that the process can be carried out at lower temperatures, the reactor need not be cooled, the heat consumption and oxygen consumption are minimized and nevertheless an undercooling of the molten bath will be reliably avoided.

What is claimed is:

1. In a continuous process of smelting metallic lead directly from lead- and sulfur-containing materials in an elongated horizontal reactor, wherein a molten bath consisting of a slag phase and a lead phase is maintained in the reactor, the slag phase and the lead phase are countercurrently conducted through the reactor, the gas atmosphere is conducted countercurrently to the slag phase through the reactor, oxygen is blown into the molten bath from below at controlled rates in the oxidation zone, which is disposed on the side where the lead is tapped, lead- and sulfur-containing material is charged at controlled rates onto the molten bath, reducing agent is introduced into the molten bath in the reducing zone, which is disposed on the side where the slag is tapped, additional heat is supplied to the gas space in the reducing zone, such an oxidation potential is maintained in the oxidizing zone that the charge is smelted in a thermally self-sufficient process to form metallic lead and a slag which contains metallic lead and lead oxide, and the rate of the reducing agent and the temperature in the reducing zone are so controlled that a low-lead slag is formed, the improvement comprising maintaining the temperature of the molten bath in the reducing zone constant by a controlled supply of additional heat, and maintaining the temperature of the molten bath in the oxidizing zone constant by controlling the ratio of oxidizable sulfur to oxygen in such a manner that in case of a temperature rise the ratio of sulfur to oxygen is increased in order to decrease the lead oxide content of the slag and in case of a temperature drop the ratio of sulfur to oxygen is decreased in order to increase the lead oxide content of the slag and the increase and decrease of the ratio of sulfur to oxygen are controlled allowing for the fact that the heat content of the gases entering the oxidizing zone from the reducing zone is changed with the lead oxide content of the slag.

2. A process according to claim 1, characterized in that a temperature of the molten bath of 900° to 1000° C. is maintained in the oxidizing zone and a temperature of 1100° to 1200° C. in the reducing zone.

3. A process according to claim 1, wherein the slag composition comprises 45 to 50% $ZnO+FeO+Al_2O_3$, 15 to 20% $CaO+MgO+BaO$ and 30 to 35% $SiO_2$, based on lead-free slag, and 30 to 70% PbO is maintained in the oxidizing zone.

* * * * *